US005694116A

United States Patent [19]

Kojima

[11] Patent Number: 5,694,116

[45] Date of Patent: Dec. 2, 1997

[54] DRIVER CONDITION-MONITORING APPARATUS FOR AUTOMOTIVE VEHICLES

[75] Inventor: Kouichi Kojima, Wako, Japan

[73] Assignee: Honda Giken Kogyo Kabushiki Kaisha, Tokyo, Japan

[21] Appl. No.: 744,240

[22] Filed: Nov. 5, 1996

[30] Foreign Application Priority Data

Nov. 6, 1995 [JP] Japan ..... 7-309747

[51] Int. Cl.[6] ..... G08B 23/00

[52] U.S. Cl. ..... 340/576; 340/575; 340/309.15; 340/439; 180/272

[58] Field of Search ..... 340/576, 575, 340/309.15, 457, 384.3, 692, 439; 180/272

[56] References Cited

U.S. PATENT DOCUMENTS

| | | | |
|---|---|---|---|
| 3,794,969 | 2/1974 | Klopfenstein et al. | 340/576 |
| 4,209,075 | 6/1980 | Messina | 180/272 |
| 4,565,997 | 1/1986 | Seko et al. | 340/575 |
| 4,594,583 | 6/1986 | Seko et al. | 180/272 |
| 4,602,247 | 7/1986 | Seko et al. | 180/272 |
| 5,101,926 | 4/1992 | Berman et al. | 180/272 |
| 5,488,353 | 1/1996 | Kawakami et al. | 340/576 |
| 5,499,182 | 3/1996 | Ousborne | 340/439 |

FOREIGN PATENT DOCUMENTS

| | | |
|---|---|---|
| 61-24209 | 6/1986 | Japan . |
| 475560 | 12/1992 | Japan . |
| 524460 | 2/1993 | Japan . |
| 596971 | 4/1993 | Japan . |

*Primary Examiner*—Thomas Mullen
*Assistant Examiner*—John Tweel, Jr.
*Attorney, Agent, or Firm*—Weiner, Carrier, Burt & Esser, P.C.; Joseph P. Carrier; Irving M. Weiner

[57] ABSTRACT

A driver condition-monitoring apparatus for an automotive vehicle. determines the condition of a driver driving the automotive vehicle and voice information for the driver is generated. A voice uttered by the driver is recognized. The voice information for the driver is generated depending on a result of determination of the condition of the driver. Oral response of the driver to the voice drivers information is judged based on a result of recognition of the voice. At least one alarming measure of giving warning, giving advice to take a rest, and controlling operation of the automotive vehicle is carried out based on a result of judgement of the response of the driver to the voice information.

20 Claims, 4 Drawing Sheets

DRIVER CONDITION-MONITORING APPARATUS FOR AUTOMOTIVE VEHICLES

BACKGROUND OF THE INVENTION

1. Field of the Invention

This invention relates to a driver condition-monitoring apparatus for automotive vehicles, which monitors the condition of the driver of a vehicle, and gives warning or the like depending upon the result of the monitoring to thereby prevent the driver from dozing or driving carelessly.

2. Discussion of Relevant Art

Conventionally, a driver condition-monitoring apparatus for an automotive vehicle has been proposed e.g. by Japanese Patent Publication (Kokoku) No. 61-24209, which repeatedly gives an alarm to the driver at predetermined time intervals, and stops the alarm only when the level of a voice response from the driver to the alarm is above a predetermined level (first conventional apparatus).

Further, other driver condition-monitoring apparatus of this kind have been proposed e.g. by Japanese Patent Publication (Kokoku) No. 4-75560 and Japanese Laid-Open Patent Publication (Kokai) No. 52-4460, which detect the body condition of the driver, such as the position of the upper part of his body and the electric potential on his skin, to determine the wakefulness or vigilance of the driver, based on information on the body condition of the driver thus obtained, and gives an alarm when the wakefulness of the driver is determined to be low (second conventional apparatus).

However, the first conventional apparatus which gives an alarm at predetermined time intervals has a lesser effect of alerting the driver by the alarm as he gets accustomed to the alarm. Further, the apparatus only gives the same alarm at fixed time intervals, but does not provide enhanced measures for assuring to alarm the driver against lowered wakefulness on his part.

On the other hand, the second conventional apparatus can make an erroneous determination that the wakefulness of the driver has lowered even when he is actually vigilant enough for safely driving the vehicle, resulting in an annoying alarm being unnecessarily given to the driver.

SUMMARY OF THE INVENTION

It is an object of the invention to provide a driver condition-monitoring apparatus for an automotive vehicle, which is capable of determining the condition of the driver while driving the vehicle with enhanced accuracy and at the same time taking more appropriate measures against the determined toward wakefulness condition of the driver.

To attain the above object, the present invention provides a driver condition-monitoring apparatus for an automotive vehicle, comprising:

- driver condition-determining means for determining a condition of a driver driving the automotive vehicle;
- voice information-generating means for generating voice information for the driver;
- voice recognition means for recognizing a voice uttered by the driver; and
- control means for causing the voice information-generating means to generate the voice information for the driver, depending on a condition of the driver determined the driver condition-determining means, judging a response of the driver to the voice drives information, based on a result of recognition of the voice drives by the voice recognition means, and carrying out at least one alarming measures of giving warning, giving information on a place to take a rest, and controlling operation of the automotive vehicle, based on a result of the judgement of the response of the driver to the voice information.

Preferably, the automotive vehicle has a navigation system installed thereon, the control means causing the voice information-generating means to generate information on a route or information on a road on which the automotive vehicle is traveling or to travel, which is provided by the navigation system, for the driver as the voice information.

Alternatively, the automotive vehicle has vehicle operating equipment installed thereon, and the control means causing the voice information-generating means to generate information as to how at least one of the automotive vehicle equipment is operating or should be operated, as the voice information.

Preferably, the control means causes the voice information-generating means to generate the voice information a plurality of times, and then determines which contents and the of the at least one alarming measure is/are to be carried out, according to the response of the driver to the voice information generated the plurality of times.

Preferably, the automotive vehicle has operating equipment installed thereon, the control means controlling operation of at least one of the operating equipment according to the response of the driver to the voice information.

More preferably, the control means controls operation of the at least one of the operating equipment according to the response of the driver to the voice information.

Further preferably, the driver condition-monitoring apparatus includes vehicle speed-detecting means for detecting a traveling speed of the automotive vehicle, and yaw rate-detecting means for detecting a yaw rate of the automotive vehicle, and the driver condition-determining means determines a level of vigilance of the driver, based on the traveling speed of the automotive vehicle and the yaw rate of the automotive vehicle, the control means causing the voice information-generating means to generate the voice information when the level of vigilance of the driver is within a predetermined range.

Preferably, the driver condition-monitoring apparatus includes warning means for giving warning, and wherein the voice information is in the form of a question, the control means counting a number of times that the driver responds to the voice information generated the plurality of times and causing the warning means to give warning at a first level when a count of the number of times that the driver respond reaches a predetermined number.

Preferably, the control means causes the voice information-generating means to generate information on a place to take a rest simultaneously when the control means causes the warning means to give the warning at the first level.

Preferably, the control means counts a number of times that no response is made by the driver to the voice information generated the plurality of times and causes the warning means to give warning at a second level higher than the warning at the first level when a count of the number of times of no response reaches a predetermined number.

Preferably, the automotive vehicle has an internal combustion engine installed thereon, the control means causing an amount of fuel supplied to the engine to be decreased simultaneously when the control means causes the warning means to give the warning at the second level.

The above and other objects, features, and advantages of the invention will become more apparent from the following detailed description taken in conjunction with the accompanying drawings.

BRIEF DESCRIPTION OF THE DRAWINGS

FIGS. 4A to 4E are graphs showing examples of changes in a detected parameter and parameters calculated based on the detected parameter, in which:

FIG. 4A shows changes in a yaw rate YR;

FIG. 4B shows changes in a yaw angle YA;

FIG. 4C shows changes in a modified yaw angle YAM;

FIG. 4D shows changes in a lateral deviation differential quantity DYK; and

FIG. 4E shows changes in a lateral deviation YK.

DETAILED DESCRIPTION

The invention will now be described in detail with reference to the drawings showing an embodiment thereof.

DESCRIPTION OF THE PREFERRED EMBODIMENT

Figure 1:
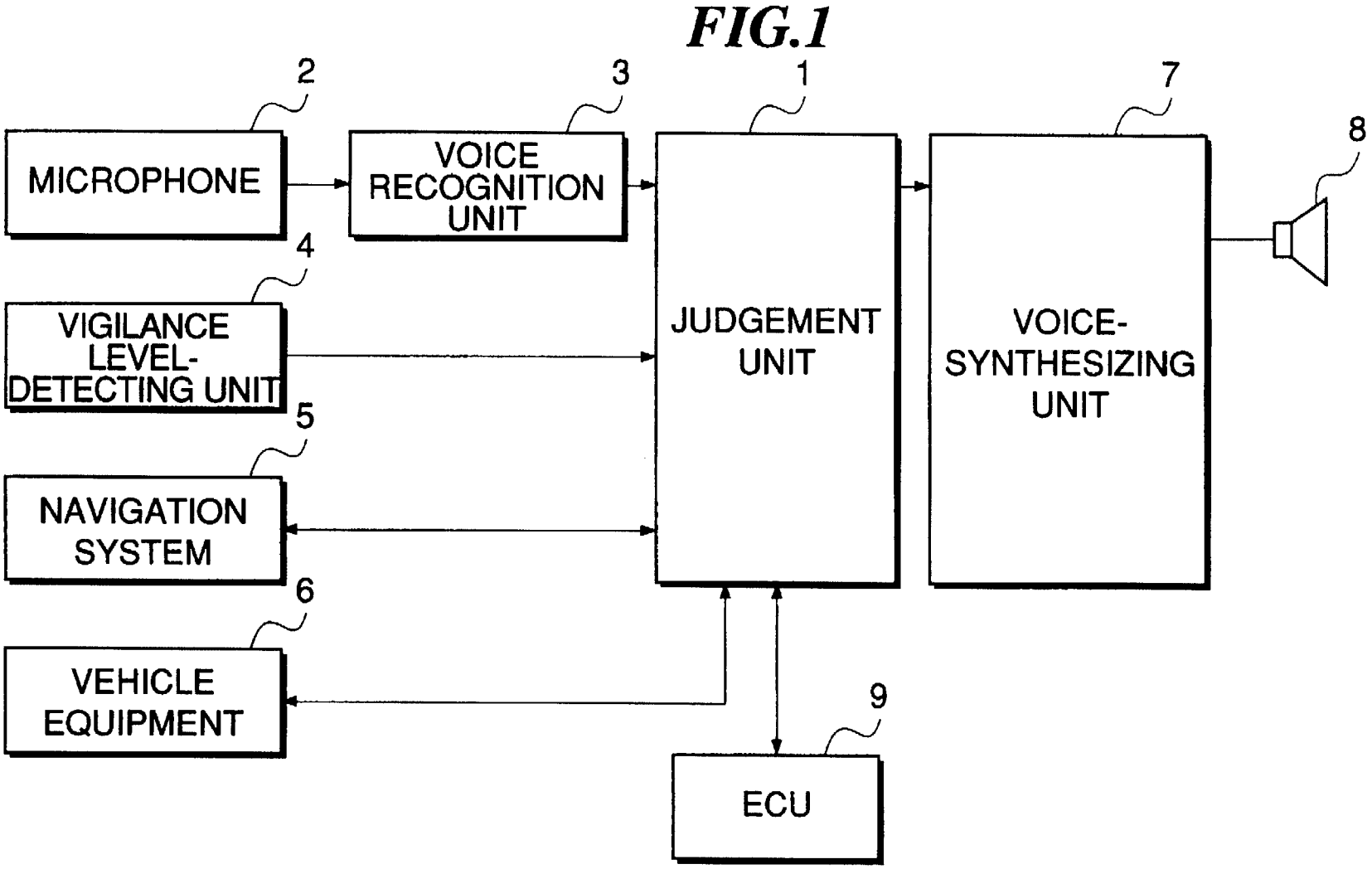
FIG. 1 is a block diagram showing the arrangement of systems and devices installed on an automotive vehicle, including a driver condition-monitoring apparatus for an automotive vehicle according to an embodiment of the invention.

Referring first to FIG. 1, there is shown the arrangement of systems and devices installed on an automotive vehicle, including a driver condition-monitoring apparatus according to an embodiment of the invention. In the figure, reference numeral 1 designates a judgement unit which determines the condition of a driver during driving the vehicle and controls execution of measures to be taken against the determined condition of the driver if necessary. The judgement unit 1 is connected to a voice recognition unit 3 which recognizes a voice of the driver based on a voice signal input via a microphone 2 and delivers a signal indicative of results of the recognition to the judgement unit 1, a vigilance level-detecting unit 4 which detects a vigilance level of the driver, a navigation system 5 which indicates a current traveling point of the vehicle on a map and gives information about routes, places to take a rest, etc., vehicle equipment 6 including an air conditioner, an in-car audio system, a power window system, etc., and an electronic control unit (hereinafter referred to as "the ECU") 9 which controls the operation of an internal combustion engine, not shown, installed on the automotive vehicle for driving the same. The microphone 2, which is connected to the voice recognition unit 3, converts the driver's voice into the voice signal and delivers the same to the voice recognition unit 3.

The judgement unit 1 is also connected to a voice-synthesizing unit 7 which synthesizes a voice signal in response to instructions from the judgement unit 1, and delivers the voice signal to a loudspeaker 8 to generate a synthesized voice.

The vigilance level-detecting unit 4 detects a yaw rate YR and a traveling speed V of the vehicle, and calculates a reference line along which the vehicle should travel and a parameter (difference) indicative of a deviation of the vehicle from the reference line, based on detected values of the yaw rate YR and the traveling speed V of the vehicle. Then, the vigilance level-detecting unit 4 determines a vigilance level X of the driver based on the calculated difference and delivers the determined vigilance level X to the judgement unit 1. The method of detecting or determining the vigilance level X will be described in detail hereinafter. It should be noted that since a larger value of the above difference indicates a lower vigilance level of the driver, the vigilance level X assumes a lower value as the difference increases.

Figure 2:
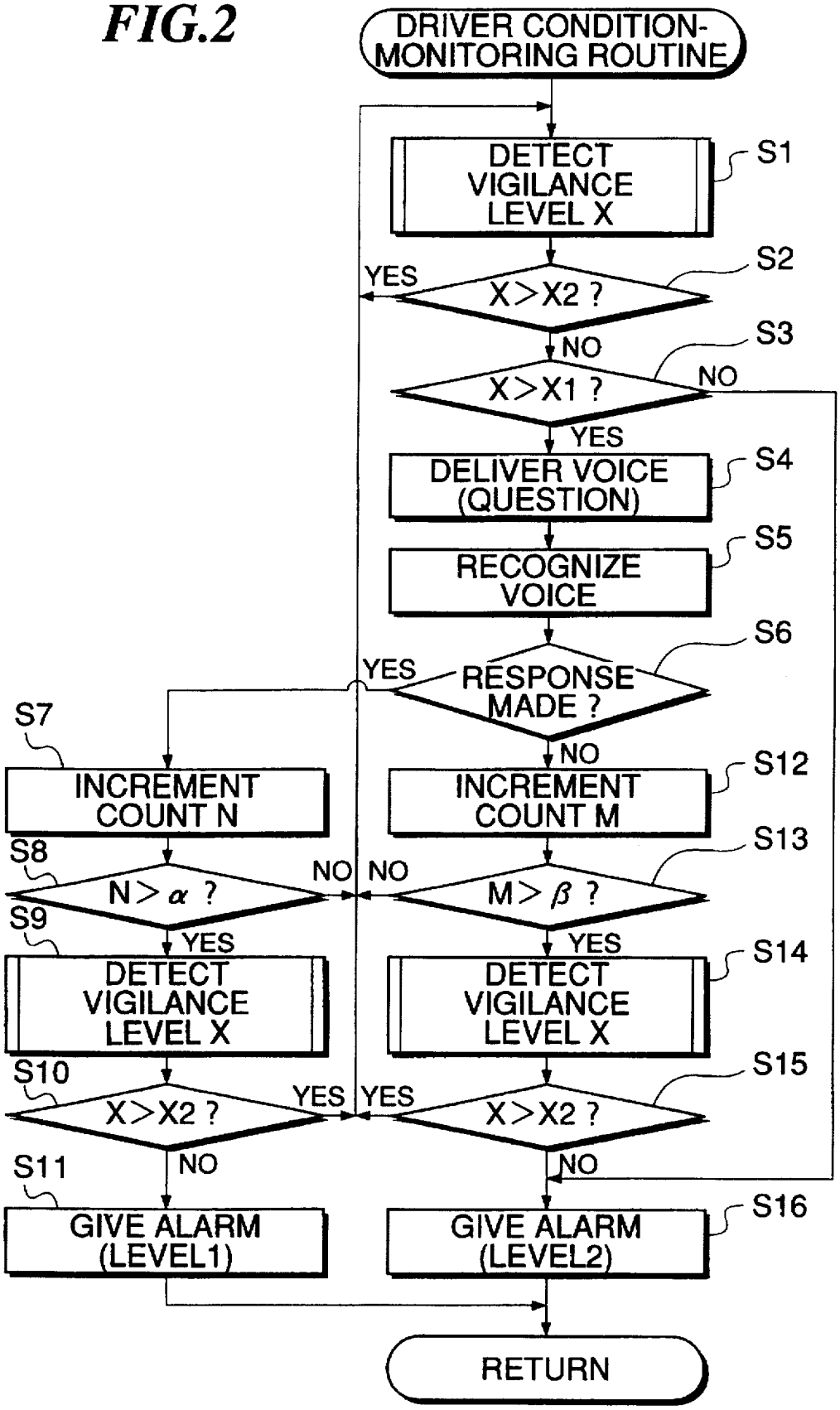
FIG. 2 is a flowchart showing a driver condition-monitoring routine executed by a judgement unit appearing in FIG. 1.

FIG. 2 shows a driver condition-monitoring routine executed by the judgement unit 1.

First, at a step S1, the vigilance level X of the driver is detected, and then it is determined at a step S2 whether or not the detected vigilance level X is higher than a second predetermined reference value X2. If $X>X2$ holds, which means that the vigilance level of the driver is sufficiently high for safety driving the vehicle, it is judged that the condition of the driver is normal, followed by the program returning to the step S1. On the other hand, if $X\leqq X2$ holds at the step S2, it is further determined at a step S3 whether or not the detected vigilance level X is higher than a first predetermined reference value X1 which is lower than the second predetermined reference value X2. If $X\leqq X1$ holds, which means that the vigilance level of the driver is considerably low, it is judged that the condition of the driver is abnormal, and the program jumps to a step S16, wherein an alarm at level 2 is given, and at the same time a predetermined fail-safe operation is carried out. The alarm at level 2 is louder than an alarm at level 1 referred to hereinafter. The predetermined fail-safe operation is carried out e.g. by progressively decreasing the amount of fuel supplied to the engine to thereby progressively decrease the output power of the engine.

If $X1<X\leqq X2$ holds at the step S3, which means that the vigilance of the driver is at a slightly low level (i.e. at a level high enough for the driver to be cautioned), the program proceeds to a step S4, wherein the driver is questioned by a synthesized voice through the loudspeaker 8 which says e.g., "Do you want to take a rest around here?" Then, recognition of a voice uttered by the driver is carried out by the voice recognition unit 3 at a step S5, and results of the voice recognition are checked at a step S6 to determine whether or not the driver has made a reply to the question asked at the step S4. If the driver has made a reply, the count N of an N counter, not shown, is incremented at a step S7, and it is determined at a step S8 whether or not the count N, which is initially set to "0", is larger than a predetermined reference value $\alpha$.

If $N\leqq\alpha$ holds at the step S8, the program returns to the step S1. If the driver is awakened or becomes more vigilant by making a reply to the question of the step S4, so that the vigilance level X detected at the step S1 becomes higher than the predetermined reference value X2, the program returns to a stand-by state in which the steps S1 and S2 are repeatedly carried out. On the other hand, if $X1<X\leqq X2$ still holds, a different question from the immediately preceding one is addressed to the driver at the step S4. For instance, if the answer to the immediately preceding question ("Do you want to take a rest around here?") is affirmative, the driver is asked a question "Which do you prefer, a service area or a parking area?", whereas if the answer to the immediately preceding question is negative, the driver is asked a question "Is it all right to take a rest at ###just as scheduled?", for example.

Then, if the count N becomes larger than the predetermined reference value α at the step S8, the vigilance level X is detected again at a step S9, and it is determined at a step S10 whether or not the detected vigilance level X is higher than the predetermined reference value X2. If X>X2 holds, the program returns to the step S1, whereas if X≦X2 holds, the alarm at level 1 is given at a step S11. The alarm at level 1 is set to a smaller volume than that of the alarm at level 2. At the same time, a predetermined fail-safe operation is carried out by giving information on a place to take a rest and/or a road on which the automotive vehicle is traveling or to travel, to the driver. For example, a map showing a nearby place to take a rest (service area or parking area) and the route thereto is displayed by the navigation system 5 to advise the driver to take a rest.

If there is no reply from the driver at the step S6, the count M of an M counter, not shown, which is initially set to "0", is incremented at a step S12, and it is determined at a step S13 whether or not the count M is larger than a predetermined reference value β. If M≦β holds, the program returns to the step S1. If X1<X≦X2 still holds at the steps S2 and S3, the same question as the immediately preceding question is made at the step S4.

If the state in which there is no reply continues and the count M exceeds the predetermined reference value β, the vigilance level X of the driver is detected again at a step S14, and then it is determined at a step S15 whether or not the detected vigilance level X is higher than the predetermined reference value X2. If X>X2 holds, the program returns to the step S1, whereas if X≦X2 holds, the program proceeds to the step S16, wherein the alarm at level 2 is given, and at the same time the aforementioned predetermined fail-safe operation is carried out.

As described above, according to the present embodiment, a question is put to the driver based on his detected vigilance level X, and then according to a response of the driver to the question, warning (alarming) and a predetermined failsafe operation such as decrease of the output power of the engine are carried out. Therefore, it is possible to determine the condition of the driver while driving an automotive vehicle with enhanced accuracy and take more appropriate safety measures in response to the condition of the driver than when the condition of the driver is determined simply based on his vigilance level. Further, to ask questions of the driver also has the effect of enhancing his vigilance level.

In addition, the question asked at the step S4 in FIG. 2 may be a question concerning how one or more of the vehicle equipment 6 are operating or should be operated. For example, the question may be one concerning the power window system, e.g. "Do you want the windows to be opened?", or one concerning the audio system, e.g. "Is the volume all right?" or one concerning the air conditioner, "Is the temperature all right?", and then a control operation may be carried out according to the driver's answer to the question. Further, the question asked at the step S4 may be one concerning information on a route or information on a road on which said automotive vehicle is traveling or to travel, which is provided by the navigation system 5.

Further, the fail-safe operation at the step S11 or S16 may be carried out by lowering the preset temperature value of the air conditioner or opening the windows to thereby raise the vigilance level of the driver.

Next, the method of detecting the vigilance level X of the driver by the vigilance level-detecting unit 4 will be described.

Figure 3:
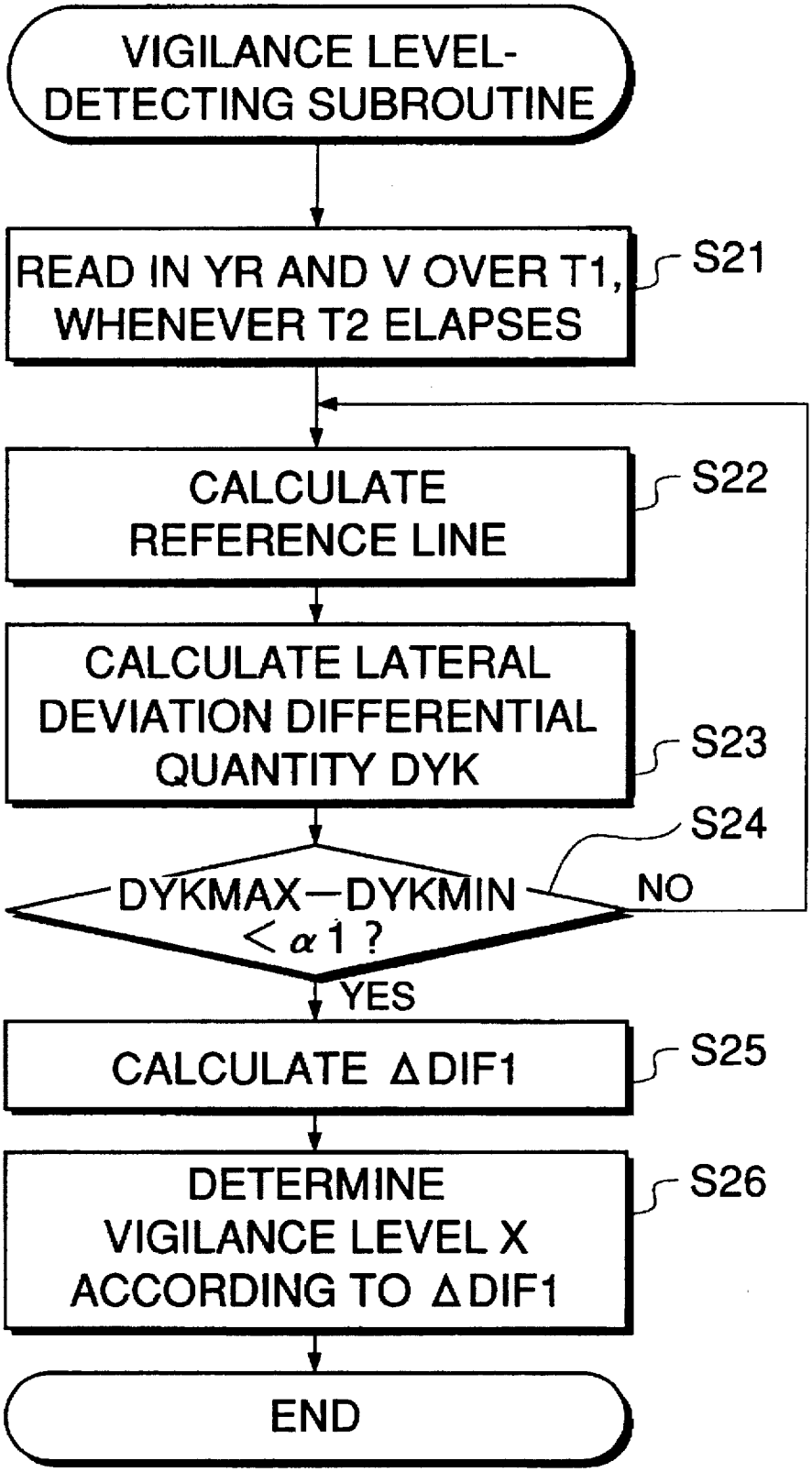
FIG. 3 is a flowchart showing a vigilance level-detecting subroutine executed by a vigilance level-detecting unit appearing in FIG. 2.

FIG. 3 shows a vigilance level-detecting subroutine executed at the steps S1, S9 and S14 in FIG. 2 by the vigilance-level detecting unit 4 for calculating the reference line along which the vehicle should travel and the parameter (difference ΔDIF1) indicative of a deviation of the vehicle from the reference line, based on the detected yaw rate YR and traveling speed V of the vehicle, and determining the vigilance level X according to the calculated difference ΔDIF1.

Figure 4A:
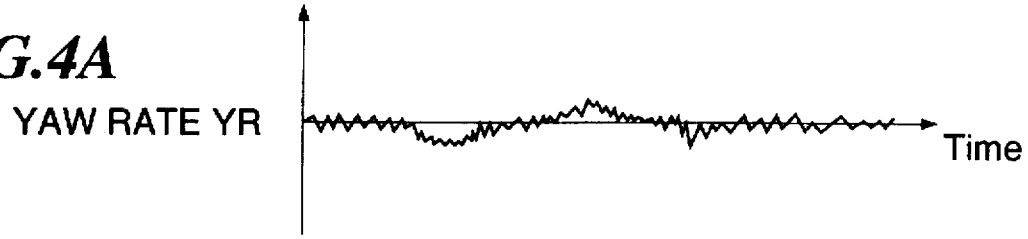
Figure 4B:
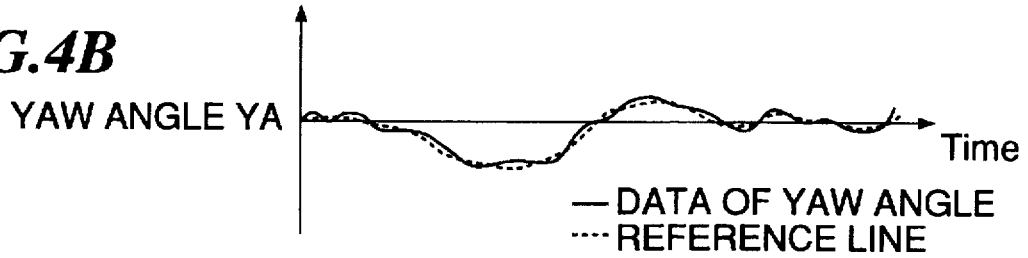

First, at a step S21, data of the yaw rate YR and the traveling speed of the vehicle (vehicle speed) V detected over a predetermined time period T1 (e.g. 30 seconds) before the present time are read in whenever a predetermined time period T2 (e.g. 10 seconds) elapses. Then, the reference line and a lateral deviation differential quantity DYK are calculated by the use of the yaw rate Y data and the vehicle speed V data at steps S22 and S23, respectively, in the following manner:

First, the input yaw rate (FIG. 4A) is time-integrated into a yaw angle YA (FIG. 4B), and further the reference line (indicated by the broken line in FIG. 4B) is calculated based on the yaw angle YA. Specifically, this calculation is carried out by a least-square method, which is well known, in the following manner: Let it be assumed, e.g. that yaw angle values YA1, YA2, and YA3 were obtained at time points t1, t2, and t3, respectively. The reference line can be approximated by the following linear expressions (1a) to (1c):

$$YA1=b1+b2t1+e1 \quad (1a)$$

$$YA2=b1+b2t2+e2 \quad (1b)$$

$$YA3=b1+b2t3+e3 \quad (1c)$$

where e1 to e3 represent residuals, and terms b1 and b2 are determined such that the sum of the squares of the residuals e1 to e3 becomes the minimum. The reference line can also be approximated by the following quadratic expressions (2a) to (2c):

$$YA1=b1+b2t1+b3\ t1^2+e1 \quad (2a)$$

$$YA2=b1+b2t2+b3\ t2^2+e2 \quad (2b)$$

$$YA3=b1+b2t3+b3\ t3^2+e3 \quad (2c)$$

where terms b1 to b3 are determined such that the sum of the squares of the residuals e1 to e3 becomes the minimum.

Further, the reference line can be approximated by the following cubic expressions (3a) to (3c):

$$YA1=b1+b2t1+b3t1^2+b4t1^3+e1 \quad (3a)$$

$$YA2=b1+b2t2+b3t2^2+b4t2^3+e2 \quad (3b)$$

$$YA3=b1+b2t3+b3t3^2+b4t3^3+e3 \quad (3c)$$

where terms b1 to b4 are determined such that the sum of the squares of the residuals e1 to e3 becomes the minimum.

When the number of sampled data is larger, higher degree expressions are further employed to carry out more accurate approximation.

Figure 4C:
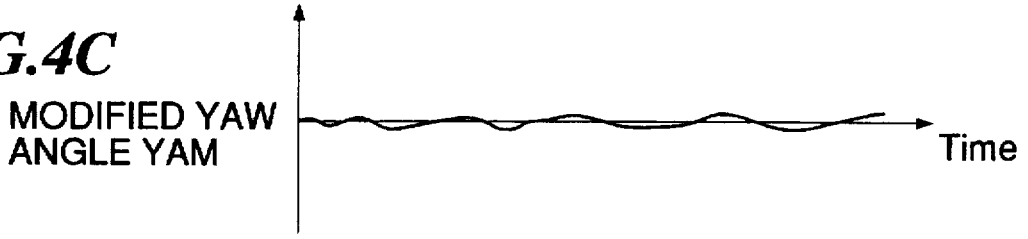
Figure 4D:
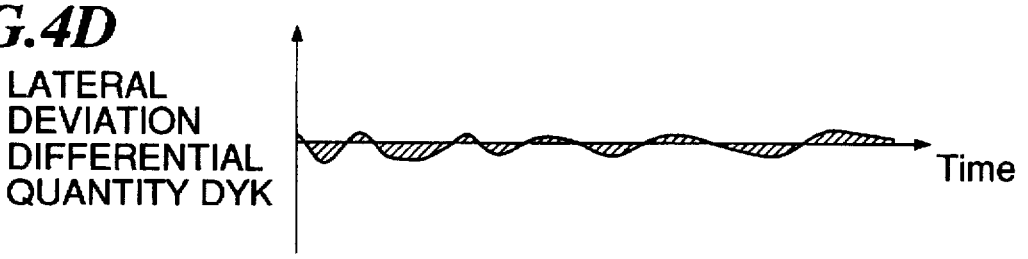
Figure 4E:
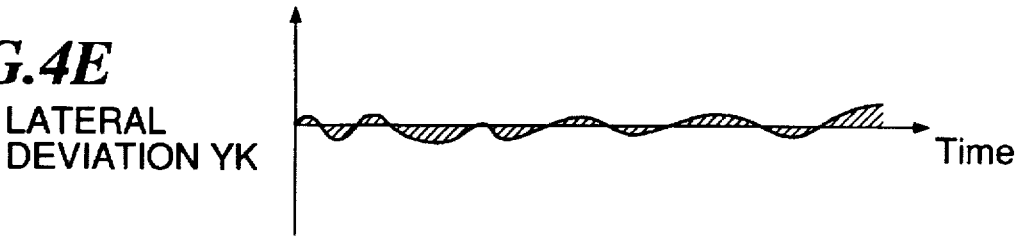

In the present embodiment, first, the reference line is determined by the linear expressions, and then a modified yaw angle YAM (FIG. 4C) is calculated by subtracting a reference yaw angle corresponding to the reference line from the yaw angle YA. Then, the lateral deviation differential quantity DYK (FIG. 4D) is calculated by applying the modified yaw angle YAM and the vehicle speed V to the following equation (4):

$$DYK=V\times\sin(YAM) \quad (4)$$

Referring again to FIG. 3, at the following step S24, it is determined whether or not the difference between the maximum value DYKMAX of the lateral deviation differential quantity DYK and the minimum value DYKMIN of the same is smaller than a predetermined value $\alpha 1$. If $(DYKMAX-DYKMIN)\geqq\alpha 1$ holds, the program returns to the step S22, wherein the order of approximation is increased by one order to again calculate the reference line. This procedure is repeatedly carried out until the answer to the question of the step S24 becomes affirmative (YES).

The program may be configured such that the calculation of the reference line is terminated when the order of approximation has reached a predetermined value even if $(DYKMAX-DYKMIN)\geqq\alpha 1$ holds at the step S24.

If $(DYKMAX-DYKMIN)<\alpha 1$ holds at the step S24, the program proceeds to a step S25, wherein the difference ΔDIF1 is calculated. The difference ΔDIF1 is calculated e.g. as the sum of the hatched areas (value obtained by time-integrating the absolute value of the lateral deviation differential quantity DYK) shown in FIG. 4D. Alternatively, a standard deviation of the DYK value or the difference between the maximum value of the DYK value and the minimum value of the same may be used as the difference ΔDIF1.

Then, the vigilance level X is determined according to the difference ΔDIF1 at a step S26, followed by terminating the program. The vigilance level X is set to a smaller value as the difference ΔDIF1 increases.

Thus, according to the FIG. 3 subroutine, the vigilance level of the driver can be determined based on the behavior of the vehicle.

The vigilance level may be detected based on an electric potential on the driver's skin, as disclosed by Japanese Laid-Open Patent Publication (Kokai) No. 5-24460 or based on information on the driver's body, such as brain wave, countenance, and body temperature, as disclosed by Japanese Laid-Open Patent Publication (Kokai) No. 5-96971.

Although there has been described what is at present considered to be the preferred embodiment of the invention, it will be understood by those skilled in the art that variations and modifications may be made thereto without departing from the spirit or essence of the invention. The scope of the invention is indicated by the appended claims, rather than by the foregoing description.

I claim:

1. A driver condition-monitoring apparatus for an automotive vehicle, comprising:

driver condition-determining means for determining a condition of a driver driving said automotive vehicle;

voice information-generating means for generating voice information for said driver;

voice recognition means for recognizing a voice uttered by said driver; and control means for causing said voice information-generating means to generate said voice information for said driver, depending on a result of a determination of said condition of said driver by said driver condition-determining means, judging a response of said driver to said voice information, based on the result of recognition of said driver's voice by said voice recognition means, and carrying out at least one alarming measure of giving warning, giving information on a place to take a rest, and controlling operation of said automotive vehicle, based on the result of said judgment of said response of said driver to said voice information.

2. A driver condition-monitoring apparatus according to claim 1, wherein said automotive vehicle has a navigation system installed thereon, and said control means causing said voice information-generating means to generate information on a route or information on a road on which said automotive vehicle is traveling or to travel, which is provided by said navigation system, for said driver as said voice information.

3. A driver condition-monitoring apparatus according to claim 1, wherein said automotive vehicle has operating equipment installed thereon, and said control means causing said voice information-generating means to generate information as to how at least one said operating equipment is operating or should be operated, as said voice information.

4. A driver condition-monitoring apparatus according to claim 1, wherein said control means causes said voice information-generating means to generate said voice information a plurality times, and then determines which and the contents of said at least one of said alarming measures to be carried out, according to said response of said driver to said voice information generated said plurality of times.

5. A driver condition-monitoring apparatus according to claim 1, wherein said automotive vehicle has vehicle equipment installed thereon, said control means controlling operation of at least one of said automotive vehicle equipment according to said response of said driver to said voice information.

6. A driver condition-monitoring apparatus according to claim 2, wherein said automotive vehicle has operating equipment installed thereon, and said control means controlling operation of at least one said operating equipment according to said response of said driver to said voice information.

7. A driver condition-monitoring apparatus according to claim 3, wherein said control means controls operation of said at least one said operating equipment according to said response of said driver to said voice information.

8. A driver condition-monitoring apparatus according to claim 4, including vehicle speed-detecting means for detecting a traveling speed of said automotive vehicle, and yaw rate-detecting means for detecting a yaw rate of said automotive vehicle, and wherein said driver condition-determining means determines a level of vigilance of said driver based on said traveling speed of said automotive vehicle and said yaw rate of said automotive vehicle, and said control means causing said voice information-generating means to generate said voice information when said level of vigilance of said driver is within a predetermined range.

9. A driver condition-monitoring apparatus according to claim 8, including warning means for giving warning, and wherein said voice information is in the form of a question, said control means counting a number of times that said driver responds to said voice information generated said plurality of times and causing said warning means to give warning at a first level when a count of said number of times that said driver responds reaches a predetermined number.

10. A driver condition-monitoring apparatus according to claim 9, wherein said control means causes said voice information-generating means to generate information on a place to take a rest simultaneously when said control means causes said warning means to give said warning at said first level.

11. A driver condition-monitoring apparatus according to claim 9, wherein said control means counts a number of times no response is made by said driver to said voice information generated said plurality of times and causes said warning means to give warning at a second level higher than said warning at said first level when a count of said number of times of said no response reaches another predetermined number.

12. A driver condition-monitoring apparatus according to claim 11, wherein said automotive vehicle has an internal combustion engine installed thereon, said control means causing an amount of fuel supplied to said engine to be decreased simultaneously when said control means causes said warning means to give said warning at said second level.

13. A driver condition-monitoring apparatus for an automotive vehicle, comprising:

means for determining a state of alertness of a driver driving the vehicle;

means for generating audible messages for the driver;

means for recognizing audible responses of the driver to the audible messages;

means for alarming the driver by providing at least one of a warning, audible information on a location to take a rest, and automatic control of an operating condition of the vehicle; and control means for controlling said generating means to generate said audible messages based on a determination of said determining means, for judging a response of said driver to the audible messages and for controlling said alarming means to alarm the driver based on an output of said recognizing means.

14. A driver condition-monitoring apparatus according to claim 13, wherein said audible messages comprise voice information, and said recognizing means recognizes a voice uttered by said driver.

15. A driver condition-monitoring apparatus according to claim 13, wherein said automotive vehicle has a navigation system installed thereon, said control means is operatively connected to the navigation system and causes said generating means to generate voice information on a route on which the automotive vehicle is traveling or to travel, based on an output from said navigation system.

16. A driver condition-monitoring apparatus according to claim 13, wherein said control means causes said generating means to generate said audible messages a plurality of times, and then determines contents of an alarm to be provided by said alarming means according to whether the driver responds to said audible messages, as recognized by said recognizing means.

17. A driver condition-monitoring apparatus according to claim 13, wherein said automotive vehicle has operating equipment installed thereon, said control means controlling operation of at least one said operating equipment according to whether the driver responds to said audible messages generated by generating means.

18. A driver condition-monitoring apparatus according to claim 13, including means for detecting an operating condition of said vehicle, and wherein said determining means determines the state of alertness of the driver based on the detected operating condition of the vehicle, and said control means causes said generating means to generate said audible messages when the state of alertness of the driver is within a predetermined range.

19. A driver condition-monitoring apparatus according to claim 13, wherein said audible messages are in the form of questions; and said control means causes said generating means to generate said audible messages a plurality of times, counts a number of times that the driver responds to the audible messages generated said plurality of times, and causes said alarming means to provide an alarm when a count of said number of times that the driver responds reaches a predetermined number.

20. A driver condition-monitoring apparatus according to claim 19, wherein said control means counts a number of times that no response is made by the driver to said audible messages generated said plurality of times, and causes said alarming means to give an enhanced alarm when a count of said number of times that no response is made by the driver reaches another predetermined number.

* * * * *

UNITED STATES PATENT AND TRADEMARK OFFICE

CERTIFICATE OF CORRECTION

PATENT NO. : 5,694,116

DATED : December 2, 1997

INVENTOR(S) : Kouichi Kojima

It is certified that error appears in the above-identified patent and that said Letters Patent is hereby corrected as shown below:

Abstract: line 7, delete "driver's"

line 8, before "voice" insert --driver's--.

Column 1, line 52, change "toward" to --lowered--.

Column 1, line 66, before "the" insert --by--.

Column 1, line 67, delete "drives".

Column 2, line 2, before "voice" insert --driver's--; delete "drives".

Column 2, line 3, change "measures" to --measure--.

Column 2, line 17, delete" automotive"; after "vehicle" insert --operating--

Column 2, line 22, after "which" insert --and the--;

line 23, delete "and the".

Column 2, line 27, before "the", insert --and--.

Column 2, line 64, before "the" insert --and--.

UNITED STATES PATENT AND TRADEMARK OFFICE

CERTIFICATE OF CORRECTION

PATENT NO. : 5,694,116

DATED : December 2, 1997

INVENTOR(S) : Kouichi Kojima

It is certified that error appears in the above-identified patent and that said Letters Patent is hereby corrected as shown below:

Column 4, line 20, change "safety" to --safely--.

Signed and Sealed this

Seventeenth Day of March, 1998

Bruce Lehman

*Attest:*

BRUCE LEHMAN

*Attesting Officer*

*Commissioner of Patents and Trademarks*